United States Patent [19]

Brighton

[11] Patent Number: 5,016,536

[45] Date of Patent: May 21, 1991

[54] NON-LETHAL PRACTICE ROUND FOR AUTOMATIC AND SEMIAUTOMATIC FIREARMS

[75] Inventor: Richard W. Brighton, London, Canada

[73] Assignee: Rainier International, Inc., Carson City, Nev.

[21] Appl. No.: 179,741

[22] Filed: Apr. 11, 1988

[51] Int. Cl.[5] ..... F42B 5/02

[52] U.S. Cl. ..... 102/430; 102/444; 102/464

[58] Field of Search ..... 102/430, 443, 447, 464, 102/498, 529; 42/76.01, 77; 89/14.05

[56] References Cited

U.S. PATENT DOCUMENTS

| | | | |
|---|---|---|---|
| 2,482,436 | 9/1949 | Ream . | |
| 2,539,968 | 1/1951 | Payne . | |
| 2,841,907 | 7/1958 | Nichols . | |
| 2,866,412 | 12/1958 | Meyer et al. | 102/430 |
| 2,944,358 | 7/1960 | Weimer . | |
| 3,049,828 | 8/1962 | Mills . | |
| 3,067,680 | 12/1962 | Lahr . | |
| 3,120,186 | 2/1964 | Harvey | 102/439 |
| 3,386,381 | 6/1968 | Ferb . | |
| 3,710,720 | 1/1973 | Mawhinney . | |
| 3,820,465 | 6/1974 | Delphia . | |
| 3,901,158 | 8/1975 | Ferb . | |
| 3,911,824 | 10/1975 | Barr . | |
| 3,952,662 | 4/1976 | Greenlees . | |
| 3,982,489 | 9/1976 | Flatau et al. . | |
| 4,204,474 | 5/1980 | Mizelle | 102/529 |
| 4,393,782 | 7/1983 | Olsen | 102/446 |
| 4,478,150 | 10/1984 | Sayler et al. | 102/430 |

*Primary Examiner*—Harold J. Tudor
*Attorney, Agent, or Firm*—Gerald L. Moore

[57] ABSTRACT

A practice round and firearm system wherein the round [10] includes a casing [11] forming a cavity [16] to receive a movable insert [20]. The insert forms a recess holding a projectile [30] and by detonation of a primer cap [36], the resulting expanding gases propel the insert and projectile forward toward the barrel passage until the insert strikes the chamber forward wall [46 to allow the projectile to continue through the barrel passage. The casing and insert thereafter move rearward with the slide [50 for automatic extraction of the spent casing from the chamber [44].

8 Claims, 1 Drawing Sheet

10
36
14
20
16
35
24
26
15
11
30

27 24 40
10
11
28
17
35
32
31
30
36
22
14
20
16 15
21
12

50
45
56
46
48
54
30
36
16
23
42
44
47

50
51
11
56
46
54
30
36
14
42
45

50
11
20
56
46
36
16
30
54
14
45

50 51
11
24
28
20
45
56
46
48
16
21
30
55
20
45

NON-LETHAL PRACTICE ROUND FOR AUTOMATIC AND SEMIAUTOMATIC FIREARMS

CROSS REFERENCE TO RELATED APPLICATIONS

This invention relates to a practice round of the type described in co-pending U.S. application Ser. No. 07/179,680 filed on Apr. 11, 1988 with Richard W. Brighton as inventor and entitled Training Round for Firearm.

BACKGROUND OF THE INVENTION

1. Field of the Invention

This invention relates to a practice round and a system for firing practice rounds which propels a projectile and provides sufficient recoil force to actuate automatic weapons.

2. Description of the Prior Art

There has long existed the need for an effective practice round for use in automatic and semiautomatic firearms. As automatic weapons are used by more and more organizations such as the military and police, the need for an effective practice round has grown. The primary problem that has existed is the providing of enough "kickback" without raising the muzzle velocity or impact force of the projectile to injurious ranges. Usually with practice or non-lethal rounds it is important to maintain lower muzzle velocities and keep the weight, and therefore the inertia of the projectile, at a minimum. However in doing so, such rounds have not provided enough back force on the slide for proper actuation of the automatic ejection mechanism of the firearm.

The ideal practice round for use with automatic and semiautomatic firearms incorporates the functions of firing a non-lethal projectile to mark the impact point, satisfactorily actuating the automatic ejection of the spent casing and insertion of a live round, functioning in a standard firearm with a minimum modification, and being relatively inexpensive. Practice firearms now being used involve those utilizing a laser, $CO_2$ actuation or blanks. Obviously the laser type devices are expensive, somewhat cumbersome, fire no projectile, and usually are not conventional in operation. $CO_2$ type practice devices are sometimes unsafe at close range and are usually not conventional in appearance and operation. The firing of blanks obviously involves no projectile to mark the point of impact tut does offer the advantage of allowing operation of the conventional weapon during practice.

It is the purpose of the present invention to provide a system and practice round which incorporates all of the advantages mentioned above and requires a minimum of modification of a standard firearm for effective operation.

SUMMARY OF THE INVENTION

A non-lethal projectile firing system that includes the combination of a conventional firearm, possibly with a slightly modified receiver, and a practice round that includes a casing forming an internal cavity that holds a movable insert having a recess to receive a non-lethal projectile. A primer cap detonated by the firearm in the conventional manner causes the insert to be propelled forward by the pressured gas of detonation to propel the projectile out the barrel. The insert in striking a forward wall of the receiver chamber causes the casing to be propelled backward for proper actuation of the slide and conventional ejection of the casing.

DESCRIPTION OF A PREFERRED EMBODIMENT OF THE INVENTION

Figures 1, 2, 3, 4, 5, 6:
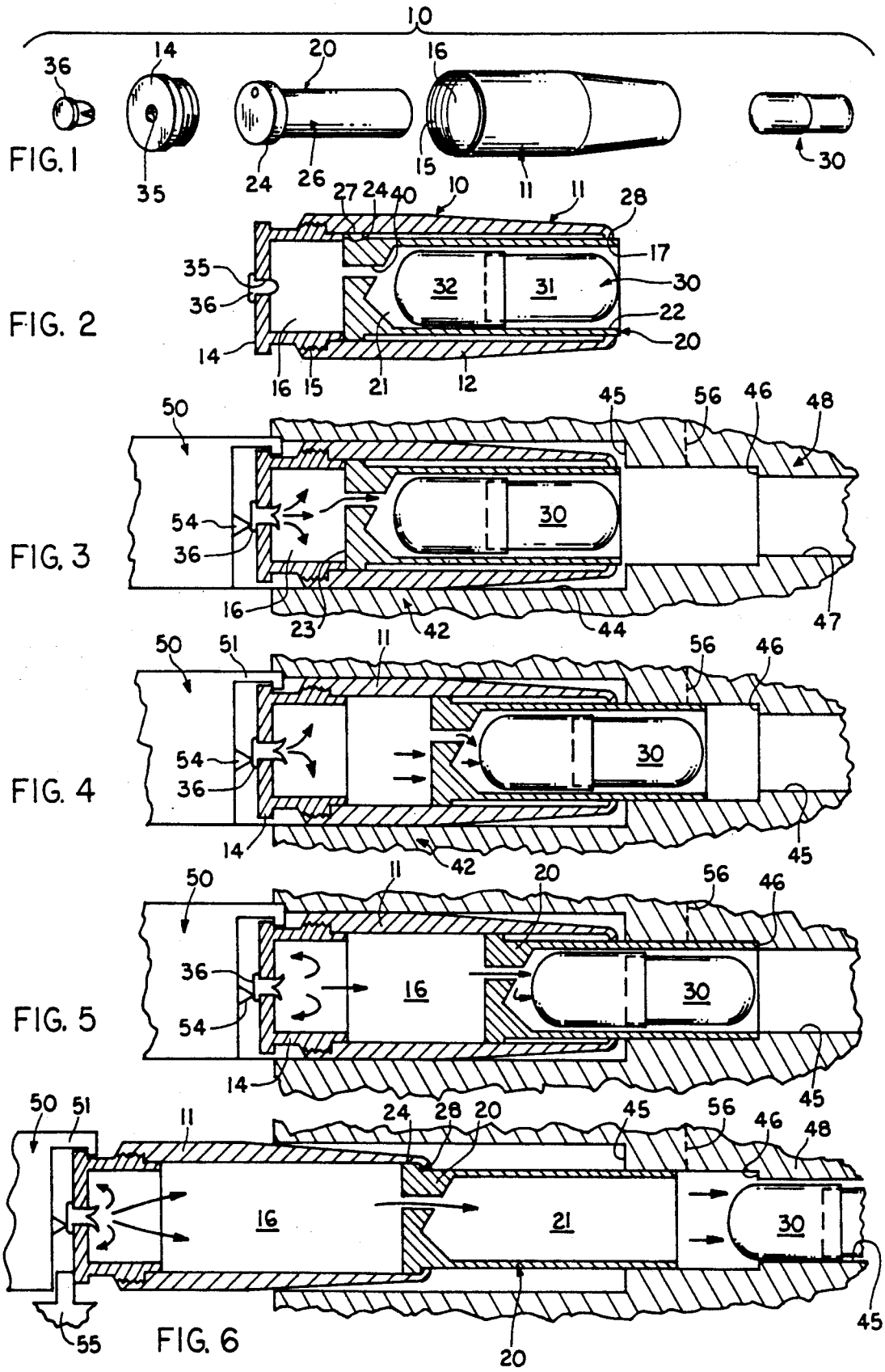
FIG. 1 is an exploded view of a practice round incorporating the subject invention.
FIG. 2 shows a cross section of the assembled round.
FIGS. 3 through 6 are cross sectional views of various stages of operation of the practice round described in the slide and receiver of a firearm.

Illustrated in FIGS. 1 and 2 is one embodiment of the invention illustrated in a practice round 10. This practice round comprises a primary casing 11 which, in this embodiment, is generally tubular in shape with side walls 12 and end cap 14 joined thereto by a threaded portion 15 to close one end of an internal cavity 16. The casing 11 forms the internal cavity with one end having an opening 17 communicating therewith.

Positioned within the casing cavity 16 is an insert 20 generally cylindrical in configuration and forming an internal recess 21 with an opening 22 communicating therewith. This insert is placed within the cavity 16 of the casing so as to form a wall member to slide back and forth between limits determined by contact between a flange 24 and the lip 27 formed by the end cap 14 and a projection 28 formed at the opposite end of the side wall 11 of the casing.

The recess 21 of the insert preferably is cylindrical to receive a non-lethal projectile 30. In this instance, the projectile is a hollow capsule formed of two sections 31 and 32 joined at the midpoint such that one overlaps the other. Such a capsule can be filled with such marking materials as a vegetable dye in gel form such that the capsule will break or flatten when propelled against a solid surface to release the colored dye and thereby mark the point of impact. Other types of materials can also be used in the projectile or to make the projectile. A more definitive description of such a capsule can be obtained by reference to the cross referenced Application Serial No.

The end cap 14 includes a center opening 35 sized to receive a standard primer cap 36 which fits therein with a friction fit. In this instance the round is a center fire type with the primer cap being centrally positioned in the end cap 14. The insert 20 includes an opening 40 providing fluid communication between the cavity 16 of the casing and the recess 21 of the insert for purposes to be explained later.

For use of the round described heretofore there is provided a receiver 42 forming a chamber 44 sized to receive the casing 11. This chamber includes a first ledge 45 and a second ledge 46 which narrows the cross sectional area to the size of the passage 47 in the firearm barrel 48. A slide 50 with an extractor 51 attached functions to receive and insert the practice round 10 into the chamber 44 of the receiver. A firing pin 54 is thereafter actuated, usually by pulling a trigger (not shown), to move longitudinally and contact the primer cap 36. As shown in FIG. 3 detonation of the primer cap causes a rapid expansion and heating of gases in the normal manner to effect a rapid pressure rise within the chamber 16. This gas immediately contacts the sidewalls of the end cap 14 and also the end wall 23 of the insert so as to impart a force tending to accelerate the insert and projectile out of the opening 17 of the casing. Additionally, the pressured gas initiates fLow into the insert opening 40 to effect a pressure buildup within the recess 21 between the projectile and the end wall of the insert.

As illustrated in FIG. 4, the insert immediately initiates action from left to right in the drawing and the capsule 30 initiates movement out of the recess toward the gun barrel passage 47. Such movement continues until the insert strikes the ledge 46 of the receiver thereby ceasing any further movement of the insert toward the firearm barrel while limiting gas flow from the cavity 16 through the barrel passage 47. However the detonation of the primer cap continues to cause a pressure buildup within the cavity 16 resulting in an initiation of a right to left movement of the casing 11 while the insert remains stationary in abutting relationship with the ledge 46. Thereafter the flange 24 on the insert and the boss 28 on the inside surface of the casing 11 contact. At the same time the slide 50 is forced backwards away from the receiver 42 in the normal manner of operation of automatic or semiautomatic firearms. With contact between the flange 24 of the insert and the boss 28 of the casing, the insert is thereafter pulled from the chamber of the receiver. Meanwhile the capsule has been propelled forward through the barrel passage of the firearm toward the target.

The rearward movement of the slide 50 and the spent casing results in the casing striking the stationary ejector 55 serving to pivot the casing and insert about the extractor 51 for ejection from the receiver. Because of the extended length of the casing and attached insert, it may be necessary to form a cutout area indicated by the dotted line 56 on one side of the receiver chamber to allow pivoting and passage of the spent casing out of the receiver.

Thus there is provided a practice round which utilizes a small detonation such as that provided by the primer cap only to propel a projectile from the firearm and also actuate the slide for automatic ejection of the spent casing. Of course such firearms frequently include the subsequent automatic injection of a live round from a magazine clip, or the like. Such mechanisms are well known and state of the art.

Thus it can be seen that the practice round described allows for use of standard firearms sometimes requiring slight modifications of the receiver barrel assembly and, in some instances, the slide to allow practice with firearms under simulated situations. Of course other modifications of the practice round and firearm are foreseen such as the inclusion of other detonating material where greater gas pressures are desired, the varying of the size of the insert opening and the use of other types of projectiles, to name a few. Obviously where necessary, the opening of one side of the receiver chamber is not detrimental to the operation of the firearm and the use of such a practice round because the pressures are maintained sufficiently low such that backing of the casing is not necessary. Such a practice round can be easily reloaded for repeated usage.

Additionally by use of a movable insert to initiate propulsion of the projectile, other types of projectiles and projectile materials can be used which otherwise might be damaged by the direct force of the propelling gases resulting from the primer cap detonation. In some instances the elimination of the opening 40 in the insert might be eliminated altogether to prevent the detonation gases from contacting the projectile. In this instance acceleration of the projectile would result totally from the acceleration of the insert.

I claim:

1. A round for firing in a firearm chamber having a forward wall forming an opening, said round comprising:

a casing forming an enclosed cavity and sized to fit within said chamber;

a primer cap held y said casing in a position to be detonated and cause a gas pressure rise in said cavity;

a projectile held by said casing in a position to be propelled through the forward wall opening by said gas pressure rise caused by detonation of said primer cap;

an insert held in said casing cavity and positioned to be propelled against the forward wall of said chamber and having a wall member positioned transversely to the longitudinal axis of said casing and having an opening therethrough to limit the further escape of pressured gas from the casing cavity after the projectile is propelled through the forward wall opening and thereby cause the casing to be moved away from the chamber forward wall and out of the chamber by the pressured gas in said casing; and means to prevent the separation of said insert from said casing cavity.

2. A round as defined in claim 1, wherein said projectile is held by said insert and the insert is positioned between said primer cap and said projectile.

3. A round as defined in claim 2, wherein said insert includes walls forming a recess with one wall forming an insert opening aligning with said casing opening through which said projectile can be propelled.

4. A round firing system comprising, in combination:

a receiver forming a chamber having a front wall and sized for receiving a round to be fired;

a barrel forming a passage for guiding a projectile propelled from said chamber;

a round sized to fit in said chamber, comprising:

a casing having outside walls formed to fit within said chamber and forming a casing opening aligning with said passage and connecting with an internal cavity formed by said casing walls;

an insert movably positioned within said casing internal cavity and having walls forming a recess connecting with an insert opening aligning with said casing opening and also having a wall member positioned transversely to the longitudinal axis of said casing and having an opening therethrough; means to prevent the separation of said insert from said casing;

a projectile in said insert recess positioned between said casing opening and insert wall member;

a primer cap mounted to detonate and expel pressured gas into said casing internal cavity in a direction to propel said insert toward said casing opening and propel said projectile through said insert opening and casing opening and said barrel passage while said insert wall member limits the escape of pressured gas from said cavity to propel said casing from said receiver chamber.

5. A firing system as defined in claim 4, wherein said insert is formed to move partially through said casing opening.

6. A firing system as defined in claim 5, wherein said insert includes a member formed to strike said chamber front wall and cause the pressure gas to propel said casing and insert out of said receiver chamber as said primer cap detonates.

7. The method of propelling a projectile from a chamber having a back wall and front wall openings, comprising the steps of:

providing a casing forming an internal cavity;

placing the projectile in the internal cavity of a casing and loading the casing in said chamber with the projectile adjacent the front wall;

positioning to extend transversely to the longitudinal axis of said casing internal cavity a wall member having an opening therethrough and positioned adjacent said projectile;

causing a rapid increase of gas pressure within said casing internal cavity to accelerate said projectile and wall member towards said chamber front wall;

allowing the projectile to pass through said chamber front wall opening while causing said wall member to contact said front wall and slow forward acceleration thereof while limiting the escape of pressured gas through said front wall opening;

allowing the gas pressure within said casing cavity to propel said casing through said chamber back wall opening; and fastening said casing and wall member together so that the casing will pull said wall member out through said chamber back wall opening.

8. A round for firing in an automatic or semi-automatic firearm, said round comprising:

an outer casing having side walls enclosing an internal cavity with one wall forming a casing opening communicating with said cavity;

a primer cap positioned to detonate in said cavity;

an insert having an opening therethrough and sized to fit in and extend transversely to the longitudinal axis of said cavity and be shifted partially out through said casing opening while limiting the expulsion of the pressured gas created when the primer cap is detonated; means to prevent the separation of said insert from said casing; and a projectile fixed to said insert to be propelled by detonation of said primer cap and movement of said insert.

* * * * *